United States Patent [19]

Hubmann et al.

[11] Patent Number: 4,733,779

[45] Date of Patent: Mar. 29, 1988

[54] PACKAGE FOR PASTE-LIKE PRODUCTS AND WRAPPER BLANK FOR USE WITH THE PACKAGE

[75] Inventors: Hans Hubmann, Neuhausen am Rheinfall; Erwin Heller, Wil, both of Switzerland

[73] Assignee: SIG Schweizerische Industrie-Gesellschaft, Neuhausen am Rheinfall, Switzerland

[21] Appl. No.: 7,399

[22] Filed: Jan. 27, 1987

[30] Foreign Application Priority Data

Jan. 27, 1986 [CH] Switzerland ..... 311/86

[51] Int. Cl.[4] ..... B65D 25/00; B65D 85/74

[52] U.S. Cl. ..... 206/509; 206/557; 206/45.34; 426/124; 426/130; 426/411

[58] Field of Search ..... 426/130, 124, 411; 206/45.31, 45.32, 45.33, 45.34, 557, 509, 551

[56] References Cited

U.S. PATENT DOCUMENTS

| | | | |
|---|---|---|---|
| 2,206,635 | 7/1940 | Hays et al. | 206/45.32 |
| 2,563,157 | 8/1951 | Castelli | 206/45.34 X |
| 2,576,708 | 11/1951 | Williamson | 206/45.34 X |
| 2,688,557 | 9/1954 | Peters | 426/124 X |
| 3,172,768 | 3/1965 | Joosten et al. | 206/45.34 X |
| 3,226,236 | 12/1965 | Weller | 426/411 X |
| 3,426,935 | 2/1969 | Swett | 206/45.34 |
| 3,563,370 | 2/1971 | Nozette et al. | 206/45.31 |
| 4,197,940 | 4/1980 | De Rossett | 206/45.32 |
| 4,362,784 | 12/1982 | Kato et al. | 426/130 X |
| 4,369,885 | 1/1983 | Redmond . | |

FOREIGN PATENT DOCUMENTS

| | | | |
|---|---|---|---|
| 675423 | 12/1963 | Canada | 206/45.34 |
| 2724306 | 12/1978 | Fed. Rep. of Germany . | |
| 8323741 | 11/1983 | Fed. Rep. of Germany . | |
| 2356574 | 6/1976 | France | 206/45.34 |
| 575320 | 5/1976 | Switzerland . | |

*Primary Examiner*—William Price
*Attorney, Agent, or Firm*—Spencer & Frank

[57] ABSTRACT

A package for slabs of butter of the type including a lower tray part and an upper tray part wherein the lower tray part does not have any edges protruding beyond the plane of a middle butter support field so that the butter can easily be cut into portions with a knife. The upper tray part, with its edge, engages a continuous furrow in the edge region of the lower tray part, where it is retained by friction. The slab of butter is covered with a wrapper material on its five sides above the support side on the lower tray part. The butter is thereby protected both mechanically and physically and it is very convenient to remove servings thereof.

9 Claims, 14 Drawing Figures

PACKAGE FOR PASTE-LIKE PRODUCTS AND WRAPPER BLANK FOR USE WITH THE PACKAGE

BACKGROUND OF THE INVENTION

The present invention relates to a package for paste-like or spreadable products, particularly butter, in slab form, to a wrapper material blank for use in the package, and to a method for packaging a cuboid shaped piece of butter using the package according to the invention.

Packages for paste-like or spreadable products, such as butter and products similar to butter, are known both for relatively large portions such as those used in the household and for single-portion packages such as those used in serving breakfast in hotels. For this latter kind of use, a precisely apportioned quantity is placed in a tray, and the tray is packed or sealed with a foil or film in an airtight, and light shielding manner. This kind of single-portion package has been described for example in Federal Republic of Germany utility model No. G-83 23 741, published November 24th, 1983.

In larger portions of 100 g and more, such as are used in the household, there is the problem that after the package, which usually comprises merely a foil or film, has been used several times, it is difficult to repack the butter so that it is still light-shielded, because the foil can wrinkle and/or tear unless it is handled extremely carefully. For these larger portions, various packages are known that form a double-tray wrapping, namely a flat underneath portion and a covering tray arching above it. Both parts are made from foil, and the two foils are welded or heat-sealed together at the edge, such as are shown, for example, in Federal Republic of Germany published patent application No. DE-A-27 24 306, published December 7th, 1978 or U.S. Pat. No. 4,369,885, issued January 25th, 1983.

SUMMARY OF THE INVENTION

The primary object of the invention is to devise a package for paste-like or spreadable products which provides good protection against mechanical strain when opened and closed repeatedly, which is easy to use, which enables easy removal of a portion of a desired size, and which does not need very much wrapper material while offering good physical protection.

The above object is attained according to one aspect of the present invention by a package for paste-like products comprising a first tray member of a rigid material having an upper surface with at least part of said surface constituting a substantially flat support surface, a slab of a paste-like product disposed on the support surface, an upper cover tray member formed of a rigid material covering the slab of product and engaging the lower tray member, and a layer of flexible wrapper material at least partially wrapped around the slab and forming an intermediate layer between the slab and the upper tray member.

According to features of the preferred embodiment of the package according to the invention, the support surface is disposed centrally in the upper surface of the lower tray member and is surrounded by a continuous indented portion of the upper surface, the peripheral edge of the slab extends beyond the peripheral edge of the support surface, and the layer of flexible wrapper material covers only the outer edge surface and the upper surface of the slab of product. Moreover, a continuous indented furrow is provided in the indented portion of the upper surface adjacent the peripheral edge of the lower tray member and surrounds the support surface, the lower edge portion of the upper cover tray member extends into the furrow and frictionally engages the walls of the furrow to form a clamping retainer for the upper tray member.

According to a further aspect of the invention a wrapper material blank for a rectangular package according to the invention comprises a parallel-sided tetragonal piece of flexible foil material having four fold lines arranged in two orthogonally disposed pairs of parallel fold lines which define a rectangular middle field, four rectangular side fields each bordering on a respective side of the middle field, and four corner squares disposed at the respective corner of the piece of flexible material, and further having four additional fold lines disposed so as to permit shaping of the respective corners of the wrapper.

Finally, according to a further aspect of the invention a method for producing and packaging a cuboid-shaped slab of butter comprises the steps of: shaping a piece of butter into a cuboid; providing a blank of wrapper material in the shape of a parallel-sided tetragonal piece of flexible material having a rectangular middle field of the size of a major surface of the cuboid, four rectangular side fields extending along the respective edges of the middle field and being of the size of the respective edge surfaces of the cuboid, and four square corner areas disposed at the respective corners of said piece of flexible material; placing the cuboid shaped slab of butter onto the wrapper blank so that one major surface is disposed within the middle field of the blank; folding at least two opposite side fields of the blank upwardly such that at least the one major surface and two side surfaces of the slab are covered by the wrapper material; providing a rectangular shaped rigid lower tray member having a substantially flat raised support surface in its center; placing the support surface of the lower tray member onto the uncovered upwardly facing other major surface of the slab; turning the slab and the lower tray member over; and covering the slab with a rigid upper cover tray member which engages the lower tray member.

DETAILED DESCRIPTION OF THE PREFERRED EMBODIMENTS

Figure 1:
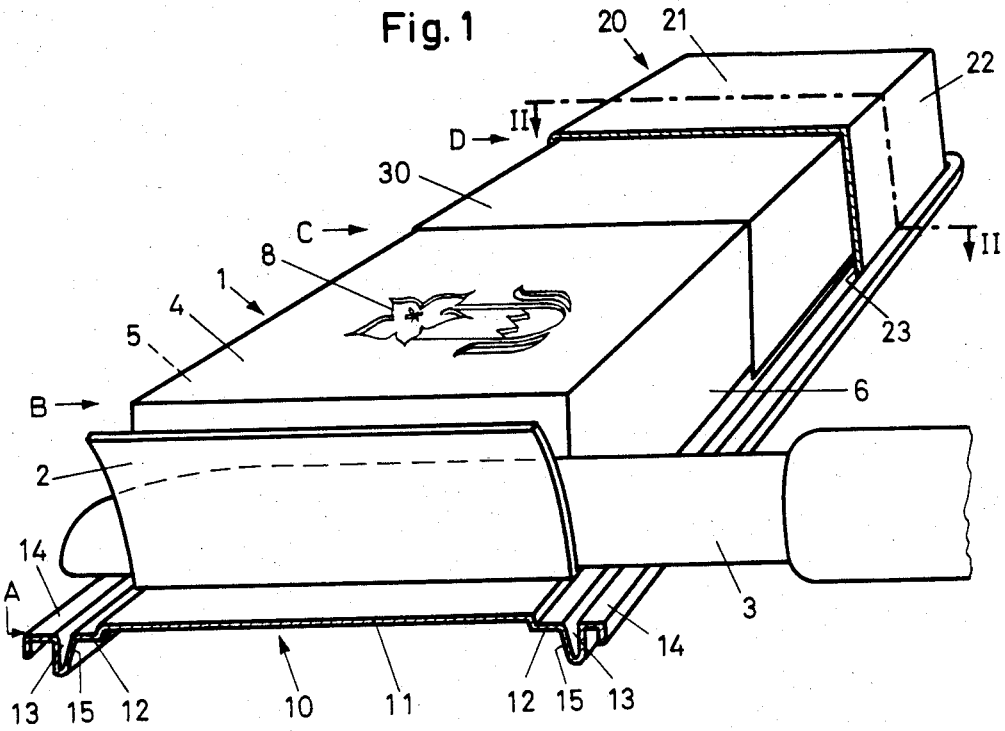
FIG. 1 is a perspective view of a slab of butter with the proposed package, shown in a view cut into layers along the cutting locations A, B, C, D.
Figure 2:
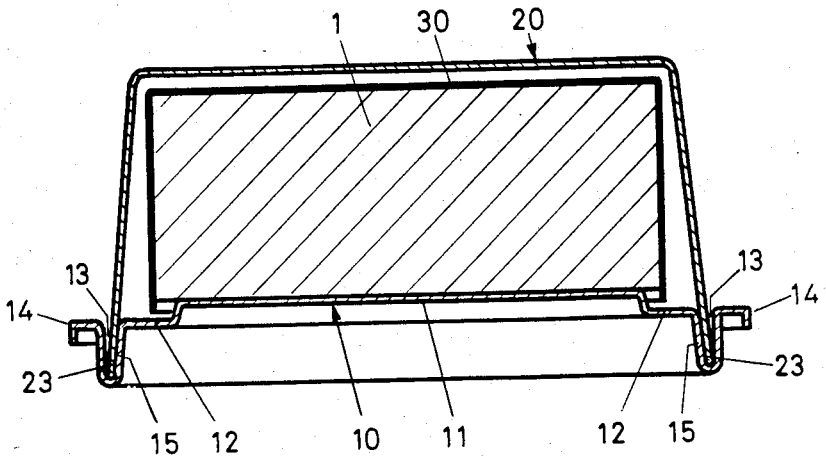
FIG. 2 is a sectional view taken along the line II—II of FIG. 1.

Referring now to FIGS. 1 and 2, the package according to the invention for a cuboid-shaped slab of butter 1 generally comprises a rectangular lower tray member 10, an upper tray or cover member 20 and a layer of wrapper material 30 disposed between the slab 1 and the upper tray member 20. The lower tray member 10 and the upper tray member 20 are each formed of a rigid material such as plastic or cardboard. The two tray members 10 and 20 may also be formed of different materials from one another.

The upper surface of the lower tray member 10 has a rectangular central or middle field portion 11 which serves as the support surface for the slab of butter 1. The portion 12 of the upper surface of the lower tray member 10 surrounding the middle support field 11 is indented relative to the field 11 so that the central support field portion 11 is in effect raised. Preferably, as shown, the dimensions of the central field portion 11, at least is the narrower or width direction, are slightly less than the corresponding dimensions of the slab of butter 1 so that the slab of butter 1 protrudes beyond the edges of the middle support field 11. Disposed in the indented portion 12 of the upper surface of the lower tray member 10 adjacent the periphery of same is a groove-like furrow 13, which also extends all around the lower tray member 10. A crimped-over outer rim 14 forms a reinforcement for the peripheral portion of the lower tray member 10.

The upper cover tray member 20 is embodied as a hollow truncated pyramid, with side walls 22 inclined slightly from the vertical and with a flat central upper field or portion 21. The lower edges 23 of the side walls 22 extend into the furrow or groove 13 and rest against one groove wall 15, i.e., the inner wall, of the surrounding furrow 13, so that the upper tray member 20 is retained in position by friction.

Figure 7:
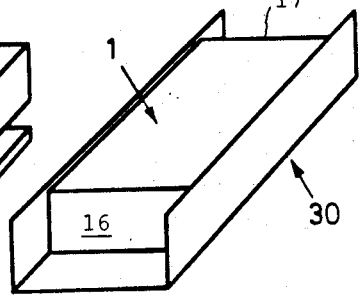

The slab of butter 1 is wrapped in a wrapper material 30, which covers five surfaces of the cuboid shaped slab of butter 1, i.e., the upper major surface 4, the longer side surfaces 5 and 6, and the shorter side surfaces 16 and 17 (see FIG. 7). As shown, the lower major surface of the slab, i.e., the major surface resting on the support surface or field 11, is not covered with the wrapper 30.

Because of the indented portion 12 of the lower tray member 10, the lower edge of the wrapper material 30 can protrude beyond the lower major surface of the slab of butter 1, as can be seen for example in FIG. 2, so that certain tolerances in terms of the height of the shaped slab do not have any influence over the surrounding package with the wrapper material.

Figure 3A:
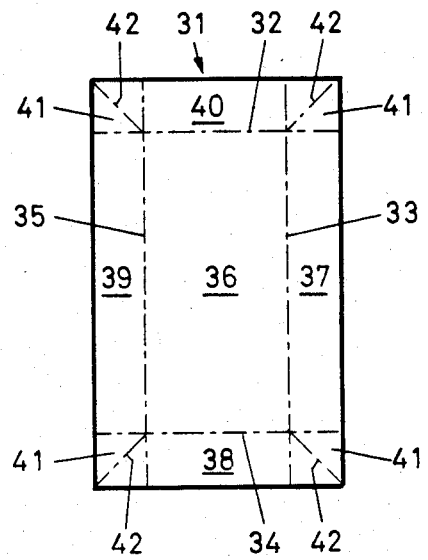
FIGS. 3*a* and 3*b* illustrate a first embodiment of a blank of the wrapper material in, respectively, its spreadout form in plan view, and in its folded state in a perspective view.
Figure 3B:
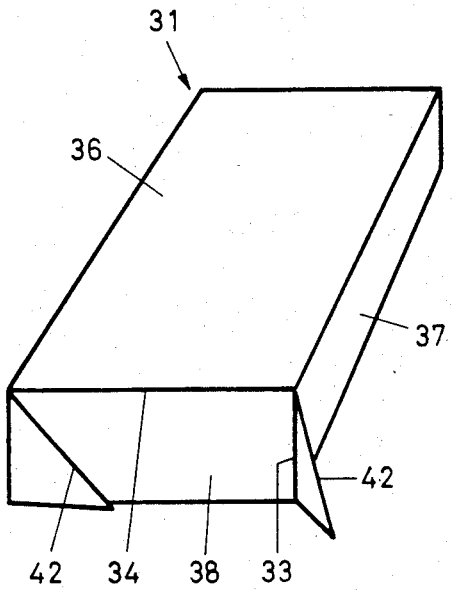

FIGS. 3*a* and 3*b* show one embodiment of a wrapper material blank which can be used to form the wrapper 30. The wrapper material blank 31 in FIG. 3a is a tetragonal or rectangularly cut piece of foil material having various indented fold lines. Four of the fold lines 32, 33, 34, 35, each extend from edge to edge of the blank 31 and are arranged in two orthogonally disposed pairs 32, 34 and 33, 35 of parallel lines so as to define a middle or central field 36, four side fields 37, 38, 39, 40 extending along the respective sides of the central field 36, and four square corner portions 41 disposed between adjacent pairs of the side fields at the respective corners of the blank 31. Four additional fold lines 42 are each disposed in a respective one of the square corner portions 41 so that they extend diagonally toward the respective outer corners of the blank 31. The size of the central field 36 corresponds substantially to that of the major surface 4 of the cuboid shaped slab of butter 1 while the sizes of the side fields 37–40 correspond substantially to those of the respective associated side surfaces 5, 6, 16 and 17 of the slab 1.

When the blank 31 of FIG. 3*a* is folded over a cuboid shaped slab as shown in FIG. 3*b*, the middle field 36 and the side fields 37–40 rest against the respective surfaces of the cuboid, and the square corner portions 41 form triangular shaped folding protrusions due to the fold lines 41. Because of the edge extending obliquely downward and toward the outside with the fold line 42, these folding protrusions come automatically to rest on the two narrow side fields 38 and 40 when the upper tray member 20 is placed over the wrapped cuboid shaped slab 1.

When the upper tray member 20 is subsequently removed, the folding protrusions stand upright and can easily be grasped, so that the wrapper material 30 can be lifted without one's fingers coming into contact with the butter. After the wrapper material 30 has been opened and a serving 2 removed, by being cut with a knife 3 (FIG. 1), the upper tray member 20 should be put back in place, so that the rest of the slab of butter 1 is protected.

Figure 4A:
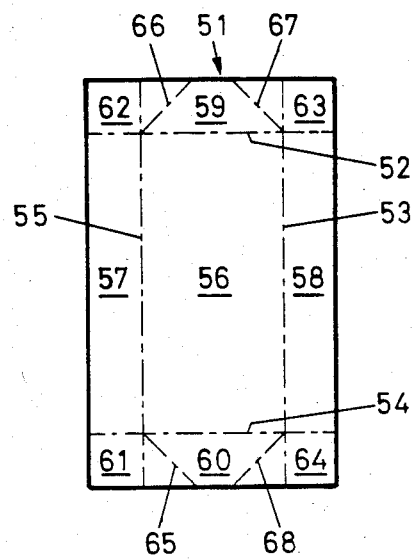
FIGS. 4*a* and 4*b* illustrate a second embodiment of a blank of the wrapper material in, respectively, its spread-out form in plan view, and in its folded state in a perspective view.

In the embodiment of a wrapper blank 51 shown in FIG. 4*a*, the four fold lines 52, 53, 54, 55 are arranged in the same manner as the fold lines 32–35 of FIG. 3*a* so as to define one middle or central field 56 with two rectangular side fields 57, 58 on its longer sides, two shorter side fields along its shorter sides, and four square corner portions 61–64. In this embodiment the four additional fold lines are arranged in two pairs 65, 68 and 66, 67, with each pair being disposed in one of the rectangular side fields extending along shorter sides of the middle or central field 56. As shown, each fold line of a pair of fold lines 65, 68 and 66, 67 extends obliquely from a respective corner of the middle field 56 to the edge of the wrapper blank 51 to define respective isosceles trapezoidal side fields 59 and 60 whose bases extend along the shorter sides of the central field 56.

Figure 4B:
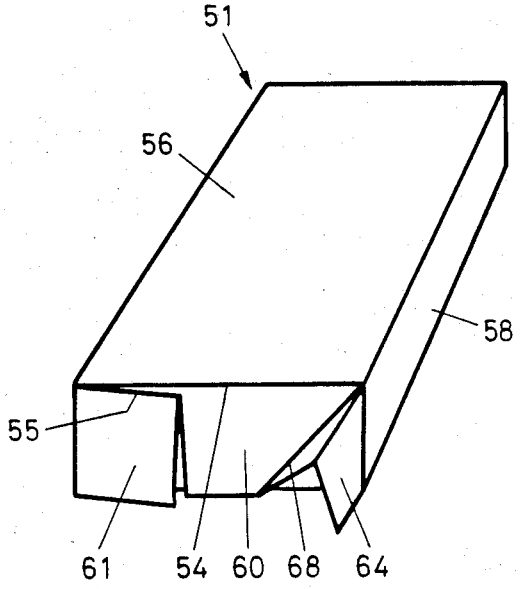

When this blank 51 is wrapped around a cuboid shaped slab of butter as shown in FIG. 4*b*, the middle field 56 and the two rectangular side fields 57, 58 come into contact with the upper major surface 4 and the side surfaces 5 and 6 of the slab 1, and the trapezoidal side fields 59, 60 defined by the fold lines 65, 66, 67, 68 come into contact with the end surfaces 16 and 17 of the slab 1. The square corner fields 61, 62, 63, 64 still protrude and are then folded in as shown on the left in FIG. 4*b*.

When this package is opened, the same process takes place as with the wrapping of FIG. 3, i.e., the protruding square corner fields 61, 62, 63, 64 can easily be grasped and the wrapper material 30 thereby raised.

In the lower tray member 10 in the example shown, the middle field 11 is a raised support surface for the slab of butter 1. The continuous relatively indented edge region 12 permits a serving of butter to be easily cut off with the knife 3 as shown in FIG. 1. Accordingly, to permit such ease of serving, the peripheral edge portion of the lower tray member 10 should not extend upwardly beyond the upper plane of the support surface 11, at least along the longer sides of the tray member 10.

It should be noted, however, that instead of the continuous furrow 13 mentioned above, the furrow 13 could extend along only the longer sides of the tray member 10, and moreover, if desired, the peripheral edge of the lower tray member 10 along its shorter ends could be raised and extend above the upper plane of the support surface 11 with the respective raised edges cooperating with the adjacent corresponding portion of the upper tray member 20 to form a snap closure in a conventional manner. This would present no hindrance to removal of servings of butter in the manner described in conjunction with FIG. 1.

It should further be noted that the middle field 11 of the lower tray member 10 does not have to be flat over its entire surface area as shown in FIGS. 1 and 2. For example, furrows or field areas having a greater depth could be indented into the material for reinforcement without making removal of butter by means of a knife more difficult.

Turning now to FIGS. 5-8, there is shown the various stages in the production and packaging of a cuboid-shaped slab of butter.

Figure 5:
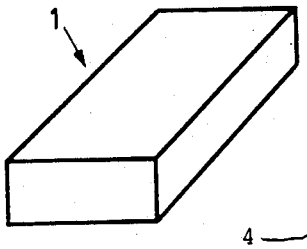
FIGS. 5–10 schematically illustrate the seven steps according to the preferred embodiment of the invention for producing and packaging a cuboid shaped slab of butter.
Figure 6:
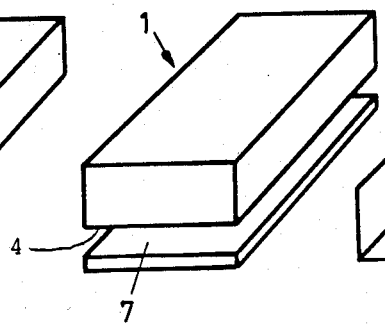
Figure 8:
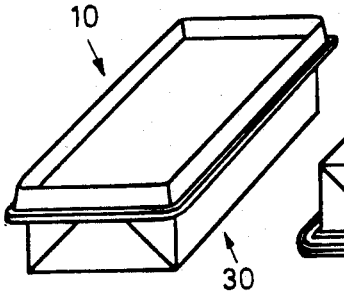
Figure 9:
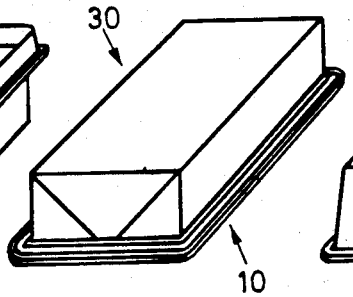
Figure 10:
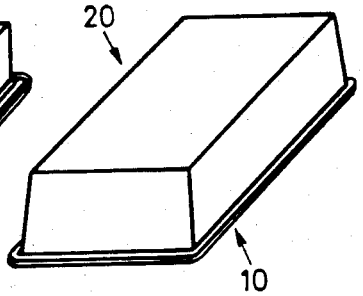

Initially, as shown in FIG. 5, a piece of butter is shaped into a cuboid 1 in a mold depression. After this shaping, and if desired, an imprint 8 (FIG. 1) can be stamped into the major surface 4 of the cuboid shaped slab of butter 1. As shown in FIG. 6, this is preferably done using a stamping die 7 disposed below the surface 4 of the slab 1. The shaped slab 1 is then placed, with its surface 4 facing downward, on the middle field 36 or 56 of the wrapper material 30, and the longer side fields of the wrapper material are folded upward as shown in FIG. 7. The lower tray member 10 is then placed onto the uncovered surface of the slab 1 from above and the narrow side fields of the wrapper 30 are folded as shown in FIG. 8. The folding of the shorter side fields of the wrapper 30 may be carried out either before or after the actual placement of the lower tray member 10 onto the slab 1. Thereafter, the partial package, including the lower tray member 10 with the slab 1 wrapped with the folded wrapper 30, is turned over as shown in FIG. 9, and finally the upper tray member 20 is placed over the wrapped slab and onto the lower tray member 10 to engage same as shown in FIG. 10.

Figure 11:
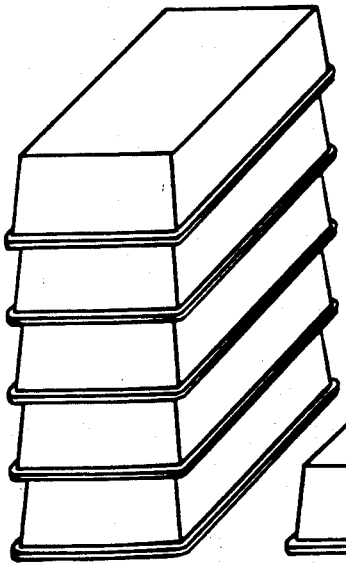
FIGS. 11 and 12 illustrate respective packaging arrangements for a plurality of packages according to the invention.
Figure 12:
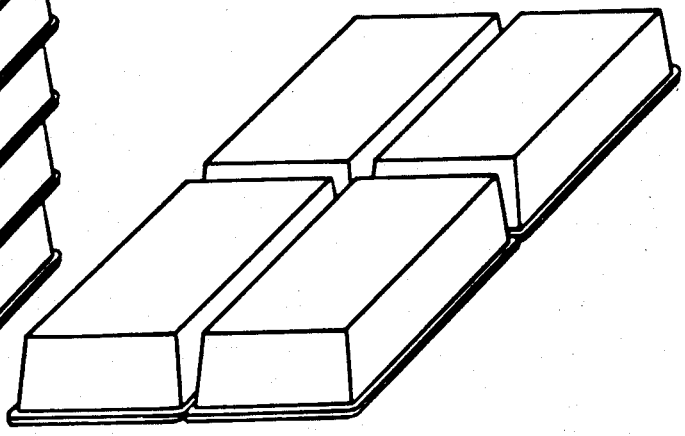

Although the lower tray member 10 could be formed as a solid piece, preferably the lower surface of the tray member 10 is hollow as shown in FIGS. 1 and 2 and is generally shaped to conform to the shape or profile of the upper portion of the upper tray member 20. Because of the inclination of the side walls of the upper tray member 20, as can be seen in FIG. 2, the upper portion of an upper tray member 10 can easily extend into the hollow space so that it is surrounded by the wall portions defining the furrows 13 so that a plurality of packages can be vertically stacked on top of one another in a stable manner as shown in FIG. 11. Naturally, however, a plurality of packages can also be arranged in a square as shown in FIG. 12.

The present disclosure relates to the subject matter disclosed in Switzerland Application No. 311/86-9 filed January 27th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A package for paste-like products comprising: a first tray member of a rigid material having an upper surface including a centrally disposed portion constituting a substantially flat support surface and a continuous indented portion surrounding said support surface; a continuous indented furrow provided in said indented protion of said upper surface adjacent the peripheral edge of said lower tray member and surrounding said support surface; a slab of a paste-like product disposed on said support surface; an upper cover tray member formed of a rigid material covering slab of product with the lower edge portion of said upper cover tray member extending into said furrow and with said furrow and said upper tray member being shaped such that said lower edge portion of said upper cover tray member frictionally engages the walls of said furrow to form a clamping retainer for said upper tray member; and a layer of flexible wrapper material at least partially wrapped around said slab and forming an intermediate layer between said slab and said upper tray member.

2. A package as defined in claim 1 wherein the peripheral edge of said slab extends beyond the peripheral edge of said support surface.

3. A package as defined in claim 2 wherein said layer of flexible wrapper material covers only the outer edge surface and the upper surface of said slab of product.

4. A package as defined in claim 1 wherein said slab and said support surface are rectangular and the peripheral edges of said slab extend beyond at least the longitudinal peripheral edges of said support surface.

5. A package as defined in claim 1, wherein said lower tray member and said support surface are rectangular; and said upper tray member has the shape of a hollow truncated pyramid.

6. A package as defined by claim 5 wherein said peripheral edges of said lower tray member constitute the end edges of the outer walls of said furrow and extend no farther upward than the upper plane of said support surface.

7. A package as defined in claim 1 wherein the lower surface of said lower tray member is hollow and shaped to correspond substantially to that of the upper outer profile of said upper cover member, whereby a plurality of said packages can be stacked vertically with the upper tray member of one package being at least partially surrounded by the lower tray member of the adjacent package.

8. A wrapper material blank for a rectangular package for paste-like products of the type including a first tray member of a rigid material having an upper surface with at least part of said surface constituting a substantially flat support surface, a slab of a paste-like product disposed on said support surface, an upper cover tray member formed of a rigid material covering said slab of product and engaging said lower tray member, and a layer of flexible wrapper material at least partially wrapped around said slab and forming an intermediate layer between said slab and said upper tray member; said wrapper material blank comprising a parallel-sided tetragonal piece of flexible foil material having four fold lines arranged in two orthogonally disposed pairs of parallel fold lines which define a rectangular middle field, four rectangular side fields each bordering on a respective side of said middle field, and four corner squares disposed at the respective corners of said piece of flexible material, and further having a four diagonal fold lines, each disposed in a respective said corner square and extending toward the respective corner of said piece of material.

9. A wrapper material blank for paste-like products of the type including a first tray member of a rigid material having an upper surface with at least part of said surface constituting a substantailly flat support surface, a slab of a paste-like product disposed on said support surface, an upper cover tray member formed of a rigid material covering said slab product and engaging said lower tray member, and a layer of flexible wrapper material at least partially wrapped around said slab and forming an intermediate layer between said slab and said upper tray member; said wrapper material blank comprisirg a parallel-sided tetragonal piece of flexible foil materia1 having four fold lines arranged in two orthogonally disposed pairs of parallel fold lines which define a rectangular middle field, four rectangular side fields each bordering on a respective side of said middle field, and four corner squares disposed at the respective corners of said piece of flexible material, and further having four further fold lines arranged in two pairs with each of said pairs being disposed in a respective one of said side fields which extends along a narrower edge of said middle field, and extending from a respective outer edge of said piece of material to the respective corners of said middle field to define a respective isosceles trapezoidal surface those base corresponds to the respective narrower side of said middle field.

* * * * *